US006228428B1

(12) United States Patent
Trankiem

(10) Patent No.: US 6,228,428 B1
(45) **Date of Patent: *May 8, 2001**

(54) COATING CUTTING EDGES WITH FLUOROCARBON POLYMERS

(75) Inventor: Hoang Mai Trankiem, Watertown, MA (US)

(73) Assignee: The Gillette Company, Boston, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/232,197

(22) PCT Filed: Oct. 23, 1992

(86) PCT No.: PCT/US92/09040

§ 371 Date: Apr. 28, 1994

§ 102(e) Date: Apr. 28, 1994

(87) PCT Pub. No.: WO93/08926

PCT Pub. Date: May 13, 1993

(30) Foreign Application Priority Data

Oct. 28, 1991 (GB) ..... 9122800

(51) Int. Cl.[7] ..... B05D 1/02

(52) U.S. Cl. ..... 427/284; 427/372.2; 427/388.5; 427/421

(58) Field of Search ..... 427/228, 284, 427/372.2, 388.5, 421

(56) References Cited

U.S. PATENT DOCUMENTS

| | | | | |
|---|---|---|---|---|
| 2,937,976 | | 5/1960 | Granahan et al. | 167/85 |
| 3,071,856 | | 1/1963 | Fishbein | 30/356 |
| 3,203,829 | | 8/1965 | Seyer et al. . | |
| 3,518,110 | | 6/1970 | Fishbein | 117/93.4 |
| 3,658,742 | | 4/1972 | Fish et al. | 260/29.6 F |
| 3,713,873 | | 1/1973 | Fish | 117/93.4 R |
| 3,766,031 | | 10/1973 | Dillon | 204/159.2 |
| 4,012,551 | * | 3/1977 | Bogaty et al. | 428/192 |
| 4,029,870 | * | 6/1977 | Brown et al. | 526/255 |
| 4,052,278 | | 10/1977 | Brown et al. . | |
| 4,102,046 | | 7/1978 | Downing et al. | 30/346.53 |
| 4,180,420 | * | 12/1979 | Sastri et al. | 148/37 |
| 4,220,511 | | 9/1980 | Derbyshire | 204/159.2 |
| 4,777,192 | | 10/1988 | Neuberg et al. . | |
| 5,001,832 | | 3/1991 | Althaus | 30/50 |
| 5,263,256 | * | 11/1993 | Trankiem | 30/346.54 |

FOREIGN PATENT DOCUMENTS

| | | |
|---|---|---|
| 0017349 | 10/1980 | (EP) . |
| 768554 | 2/1957 | (GB) . |
| 906005 | 9/1959 | (GB) . |
| 1282410 | 7/1972 | (GB) . |
| 2119385 | 11/1983 | (GB) . |

OTHER PUBLICATIONS

Teflon MP1100 Technical Information, DuPont Polymer Products (10/90).
Wiley, Encycl. of Polymer Science and Tech. vol. 4, p. 652 (1986).
Kusy et al. J. Pol. Sc., 10, 1745–1762 (1972).

* cited by examiner

*Primary Examiner*—Fred J. Parker

(57) ABSTRACT

A method of forming a polyfluorocarbon coating on a razor blade cutting edge comprises subjecting a fluorocarbon polymer having a molecular weight of at least 1,000,000 in dry powder form to ionizing irradiation to reduce the molecular weight of the polymer forming a dispersion of the irradiated polymer in a volatile organic liquid, spraying the dispersion on to a razor blade cutting edge, and heating the coating obtained to sinter the polyfluorocarbon. The polyfluorocarbon preferably is polytetrafluoroethylene and irradiation preferably is effected to obtain a telomer having a molecular weight of about 25,000.

6 Claims, No Drawings

COATING CUTTING EDGES WITH FLUOROCARBON POLYMERS

BACKGROUND OF THE INVENTION

1. Field of the Invention

This invention is concerned with a method of coating cutting edges, more particularly razor blade cutting edges, with fluorocarbon polymers.

2. Description of Related Art

For many years razor blade cutting edges have been coated with polyfluorocarbons, more particularly polytetrafluoroethylene (PTFE); see, for example, British Specification 906005. The polyfluorocarbons used for this purpose are telomers, that is they are polymers having a relatively low molecular weight. Thus the PTFE conventionally used for the coating of razor blade cutting edges has a molecular weight of about 25000, as compared with PTFE which is conventionally used for the formation of non-stick coatings which has a molecular weight of 3–6 million.

The reason for using fluorocarbon telomers rather than high molecular weight materials for coating cutting edges is that the former give improved blade-to-blade uniformity and coatings of improved durability.

Polyfluorocarbons, such as PTFE, are conventionally made by polymerization of the monomer in an aqueous dispersion and this gives rise to the high molecular weight material referred to above. Fluorocarbon telomers are made by polymerization in a chlorofluorocarbon, such as trichlorotrifluoroethane. However, in view of mounting pressure on industry for environmental reasons to eliminate the use of CFCs in manufacturing processes and in products, there is a need to use an alternative process for making fluorocarbon telomers.

BRIEF SUMMARY OF THE INVENTION

We have now found that fluorocarbon telomers, more particularly, tetrafluoroethylene telomers, made by subjecting high molecular weight polyfluorocarbons in dry powder form to ionizing irradiation can be used to form excellent polyfluorocarbon coatings on razor blade cutting edges, that is coatings having properties equivalent to those obtained with fluorocarbon telomers made by polymerization in a chlorofluorocarbon. For the purpose of forming such coatings the telomer formed by irradiation is dispersed in a volatile organic solvent, such as isopropanol, the dispersion is sprayed on to the cutting edges and heated to remove the solvent and sinter the telomer, the steps of spraying and heating being carried out under generally conventional conditions.

DETAILED DESCRIPTION OF THE INVENTION

According to the present invention, there is provided a method of forming a polyfluorocarbon coating on a razor blade cutting edge, which comprises subjecting a fluorocarbon polymer having a molecular weight of at least 1,000,000 in dry powder form to ionizing irradiation to reduce the molecular weight of the polymer, forming a dispersion of the irradiated polymer in a volatile organic liquid, spraying the dispersion on to a razor blade cutting edge and heating the coating obtained to sinter the polyfluorocarbon.

The radiation dose is preferably from 20 to 80 megarad and the ionizing radiation is preferably by γ-rays from a $Co^{60}$ source.

The polyfluorocarbon is preferably polytetrafluoroethylene and irradiation is preferably effected to obtain a telomer having a molecular weight of about 25,000.

For the purpose of forming the dispersion which is sprayed on to the cutting edges, the irradiated polyfluorocarbon should have a fine particle size, preferably an average particle size of not more than 100 microns. The powdered polyfluorocarbon starting material will normally be available as a coarser material than this and it may be ground to this fineness either before or after the irradiation step, preferably the latter.

A large number of volatile organic liquids are suitable for use as the liquid medium of the dispersion; it is currently preferred to use isopropanol. The dispersion preferably contains not more than 1% by weight of the fluorocarbon telomer, for example about 0.5 to 0.7% by weight.

The good results obtained by the method according to the invention which, as stated above, are equivalent to those obtained with fluorocarbon telomers made by polymerization in chlorofluorocarbons—the materials which are currently used to make coatings on razor blade cutting edges—is surprising since we have found that equivalent results cannot be obtained by subjecting high molecular weight polyfluorocarbons present in liquid dispersions to ionizing irradiation, and then using such irradiated dispersions to form the coating. While polyfluorocarbon coatings can be formed by the latter procedure, they do not have the properties looked for in such coatings on razor blade cutting edges. The reason for the significance of carrying out the irradiation with the polyfluorocarbon in the form of a dry powder is not known.

In order that the invention may be more fully understood, the following example is given by way of illustration only.

EXAMPLE

Polytetrafluoroethylene ("Teflon® 60", Trade Mark, supplied by E.I. du Pont de Nemours & Co.) having a molecular weight in excess of 1,000,000 and in the form of a dry powder, was placed in ampoules of heat-resistant glass and the ampoules were exposed to γ-irradiation from a $Co^{60}$ source at room temperature (25° C.) in air, the dose rate being 3 megarads/hour. After the polymer had received a radiation dose of about 25 megarads, radiation was stopped and the powder was taken out of the ampoules. No discoloration of the powder was observed. Air was blown through the irradiated material to remove the hydrogen fluoride generated by the irradiation of the polytetrafluoroethylene. The irradiated powder was then ground in a grinder to reduce the particle size and passed through a 100 micron sieve.

A dispersion containing 0.7% by weight of the ground and sieved powder in isopropanol was prepared and homogenized with an ultrasonic stirrer. Stainless steel razor blade cutting edges were then sprayed with the dispersion. After drying, the coating on the blade edges was sintered in nitrogen at 650° F. (343° C.) for 35 minutes. The blades so treated exhibited greater blade-to-blade uniformity, better blade performance and the same coating durability as similar blades which had been treated in exactly the same way, but omitting the irradiation step.

What is claimed is:

1. A method of forming a polyfluorocarbon coating on a razor blade cutting edge, which comprises subjecting a fluorocarbon polymer powder having a molecular weight of at least 1,000,000 in dry powder form to ionizing radiation of from about 20 to about 80 megarads to reduce the molecular weight of the polymer to obtain a telomer, forming a dispersion of the telomer in a volatile organic liquid which is free of chlorofluorocarbon solvents, spraying the dispersion on to a razor blade cutting edge, and heating the coating obtained to sinter the polyfluorocarbon telomer.

2. A method according to 1, in which the ionizing radiation is by γ-rays from a $Co^{60}$ source.

3. A method according to claim 2, in which the polyfluorocarbon is polytetrafluoroethylene and irradiation is effected to obtain a telomer having a molecular weight of about 25,000.

4. A method according to claim 3, in which the irradiated polyfluorocarbon in the dispersion has an average particle size of not more than 100 microns.

5. A method according to claim 4, in which the dispersion contains from about 0.5 to 0.7% by weight of the telomer.

6. A Method according to claim 3, in which the volatile organic liquid of the dispersion is isopropanol.

* * * * *